United States Patent [19]

Maziasz

[11] Patent Number: 4,603,682

[45] Date of Patent: Aug. 5, 1986

[54] THREE-DIMENSIONAL FIREPLACE INSERT

[76] Inventor: Daniel E. Maziasz, 27630 Parkview #412, Warren, Mich. 48092

[21] Appl. No.: 673,042

[22] Filed: Nov. 19, 1984

[51] Int. Cl.[4] ..... F24B 1/18

[52] U.S. Cl. ..... 126/120; 126/202; 126/319; 126/140

[58] Field of Search ..... 126/141, 201, 319, 120, 126/121, 140, 39 M, 202; 40/428

[56] References Cited

U.S. PATENT DOCUMENTS

| | | | |
|---|---|---|---|
| 926,910 | 7/1909 | Taylor | 126/120 |
| 1,010,101 | 11/1911 | Weaver | 40/428 |
| 1,069,944 | 8/1913 | Haggard | 126/120 |
| 1,470,542 | 10/1923 | Poling | 126/140 |
| 1,858,967 | 5/1932 | Pettiegrew | 126/120 |
| 3,460,525 | 8/1969 | Bryant | 126/120 |
| 3,616,788 | 11/1971 | Hannebaum | 126/140 |
| 3,888,232 | 6/1975 | Le Brun | 126/140 |
| 3,921,619 | 11/1975 | Barriball | 126/140 |
| 4,151,827 | 5/1979 | Roe | 126/121 |
| 4,183,348 | 1/1980 | Smith | 126/202 |
| 4,194,490 | 3/1980 | Crnkovic | 126/141 |
| 4,305,374 | 12/1981 | Taylor | 126/121 |
| 4,375,803 | 3/1983 | Love | 126/121 |
| 4,441,482 | 4/1984 | Luscombe | 126/140 |
| 4,446,848 | 5/1984 | Becker et al. | 126/121 |
| 4,470,400 | 9/1984 | Fleisler | 126/121 |
| 4,475,531 | 10/1984 | Gerhart | 126/121 |

FOREIGN PATENT DOCUMENTS

| | | | |
|---|---|---|---|
| 1158792 | 7/1969 | United Kingdom | 126/39 M |

*Primary Examiner*—Samuel Scott
*Assistant Examiner*—Helen Ann Odar
*Attorney, Agent, or Firm*—Remy J. VanOphem

[57] ABSTRACT

A three-dimensional fireplace insert which is intended to be placed in the firebox of a fireplace that is not in use and to substantially seal the opening to the fireplace. Such insert may be decorated to enhance the appearance characteristics by painting or printing decorative material on the exposed inside surfaces thereof and/or by placing a decorative object or objects therein. Various members of the fireplace insert may be formed in one piece from a suitably shaped blank of a suitable material by the folding of such blank, and a bi-axially extensible frame may be provided to be positioned within the opening of such an insert to facilitate the accurate positioning of the front edges of the insert with respect to the fireplace opening. Organic materials, such as thermoplastic materials and fiberglass reinforced thermoplastic materials may be used to advantage in the manufacture of the fireplace insert. Separate sealing materials can be provided for optimum sealing characteristics between the fireplace insert and the fireplace opening.

6 Claims, 4 Drawing Figures

THREE-DIMENSIONAL FIREPLACE INSERT

BACKGROUND OF THE INVENTION

1. Field of the Invention

This invention relates to a three-dimensional insert for a fireplace. More particularly, this invention relates to a three-dimensional insert for a fireplace to seal the fireplace when it is not in use to prevent the drawing of air through the fireplace by the fireplace chimney. In the preferred embodiment of the invention the fireplace insert is provided with decorative material placed on the inside thereof to present a pleasing appearance toward the room in which the fireplace is located. This decorative material can be in the form of pictures painted or printed on the exposed surfaces of the fireplace and, because of the three-dimensional format, such decorative material can be especially attractive. Alternatively, the decorative material can be in the form of a decorative physical object or objects placed in the insert, for example, a plant, a rock formation, a sculpture, an aquarium or the like. Where desired, the appearance of the decorative material can be enhanced by lights located within or behind the fireplace insert or in the chimney above it.

A fireplace insert according to the present invention can be advantageously formed from a unitary blank of a sheet of material, for example, a generally cruciform-shaped blank which can be produced by die-cutting, to permit the rapid assembly of an insert by folding a blank selected from a stack of such blanks. This will permit the assembly of fireplace inserts from blanks which may be compactly shipped and stored in a distribution center or retail store. When this is done, an extensible or telescopic rectangular frame can be provided to facilitate the accurate positioning of the front edges of the members of the insert with respect to the fireplace opening.

Where desired, a fireplace insert according to the present invention can be provided with a somewhat tapered configuration for ready insertion into the firebox of a fireplace, or for insertion into a fireplace in which the firebox itself is tapered in configuration.

2. Description of the Prior Art

The prior art discloses various devices for covering or closing stovepipes, stovepipe holes, flue holes and flues, and recognizes that it is desirable to decorate these devices for aesthetic reasons. See, for example, prior U.S. Pat. No. 107,722 (Reed), U.S. Pat. No. 853,177 (Knapp), and U.S. Pat. No. 541,746 (Hall). These devices, however, cover or close the associated opening on the outside thereof, and do not suggest an insert which extends into the opening being closed to provide an exposed recess which can be utilized to preserve the natural recessed appearance of the fireplace opening. Additionally, the devices described in the U.S. patents listed above are dimensionally fixed with respect to the size of the openings they are to be used with, and cannot be extended to provide close contact with the periphery of the opening being closed.

SUMMARY OF THE INVENTION

In accordance with the present invention a three-dimensional insert for a fireplace is provided. The insert is adapted to be inserted within the firebox of the fireplace so that it substantially seals the fireplace when it is not in use to prevent the drawing of air therethrough to conserve energy and to prevent occupants of the room from being discomforted by the resulting drafts in the room. At the same time, the insert does not substantially block the front opening of the fireplace and, therefore, preserves the recessed appearance of the fireplace which may be desirable to the occupants of the associated dwelling. Because of the recessed nature of the fireplace insert, visually attractive decorations may be placed therein in the form of pictures printed or painted on the exposed surfaces of the insert or in the form of a decorative physical object or objects placed therein.

In the preferred embodiment, the fireplace insert is formed from a unitary knocked-down blank of a suitable sheetlike material by folding. This will permit an insert to be assembled from a supply of such blanks in order to be able to minimize the volume occupied by the fireplace inserts during shipment and storage. When the fireplace insert is formed in this manner, a bi-axially extensible or telescoping frame may be provided to accurately position the front edges of the members of the blank with respect to the opening of the fireplace. When the fireplace insert is formed from such a blank, it is desirable to use a thin sheetlike material for the construction of the blank for ease and economy in the manufacture thereof and for compact stacking of the blanks during transportation and storage. Organic materials, for example, thermoplastic materials and fiberglass reinforced thermoplastic materials, may be advantageously used to form such sheetlike blanks because these organic materials are relatively inexpensive, have good strength to weight characteristics, are not subject to corrosion, and can be formed with an attractive finished appearance which is important in the manufacture of articles that are intended for household use.

Where an optimum sealing relationship between the fireplace insert and the associated fireplace is needed or desired, for example, to minimize air loss from the room in areas where heating or air conditioning costs are quite high, the character of the seal between the fireplace insert and the fireplace opening can be enhanced by providing the outside periphery of the insert with a soft gasketing material attached or bonded thereto to seal against the inside periphery of the fireplace opening.

Since many of the fireplaces in existence have a firebox whose sides taper inwardly to some extent, a fireplace insert according to with the present invention can be made in a similarly tapered form by constructing the top and bottom members of the insert in the shape of a trapezoid with the shorter of the parallel sides to the rear and the longer of the parallel sides to the front, where they will be positioned within the fireplace opening. Such a tapered construction can be used even in connection with a fireplace whose firebox sides are parallel to one another, and in such case the taper of the fireplace insert will make it somewhat easier to install it in the fireplace. Additionally, this taper can be used to aesthetic advantage in connection with decorations in the insert in the form of three-dimensional drawings, since it will lend a perspective illusion thereto.

Accordingly, it is an object of the present invention to provide a three-dimensional fireplace insert for insertion into the firebox of a fireplace to substantially seal the fireplace in an aesthetically pleasing manner.

It is a further object of the present invention to provide a three-dimensional fireplace insert which can be readily assembled from a unitary blank of a thin sheetlike material, to simplify the shipping and storage of such fireplace inserts.

It is a further object of the present invention to provide a biaxially extensible frame for a fireplace insert which is assembled from a unitary blank of a thin sheetlike material to permit the front edges of the separate pieces to be accurately positioned with respect to the opening of the fireplace.

These and many other objects, features, and advantages of the present invention will become apparent to those skilled in the art when the following detailed description is read in conjunction with the drawings appended hereto.

DETAILED DESCRIPTION OF THE PREFERRED EMBODIMENT

Figure 1:
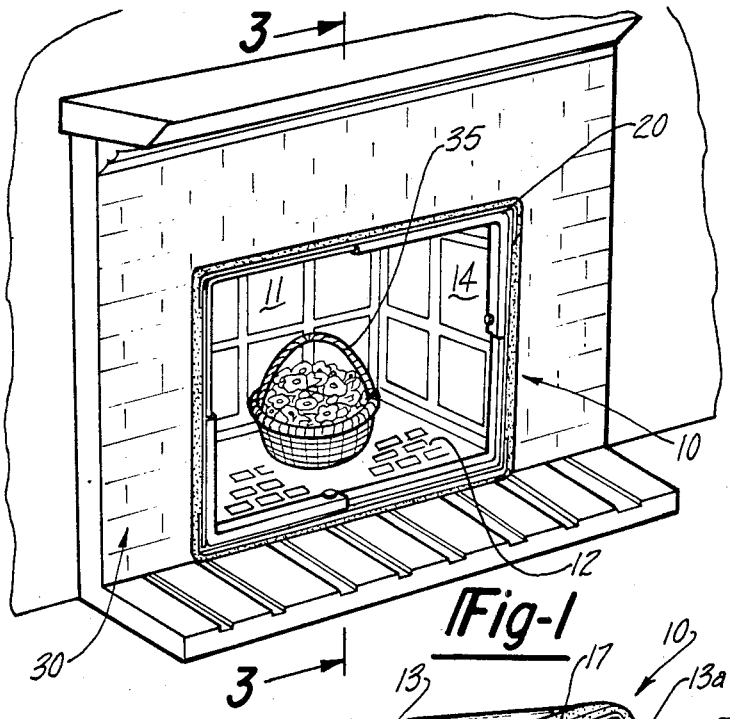
FIG. 1 is a fragmentary three-dimensional view of a fireplace insert according to the present invention installed in a fireplace.
Figure 3:
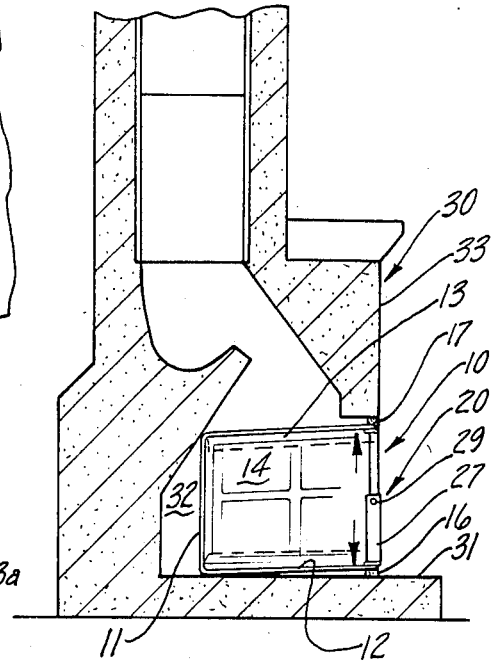
FIG. 3 is a sectional view taken along lines 3—3 of FIG. 1.
Figure 2:
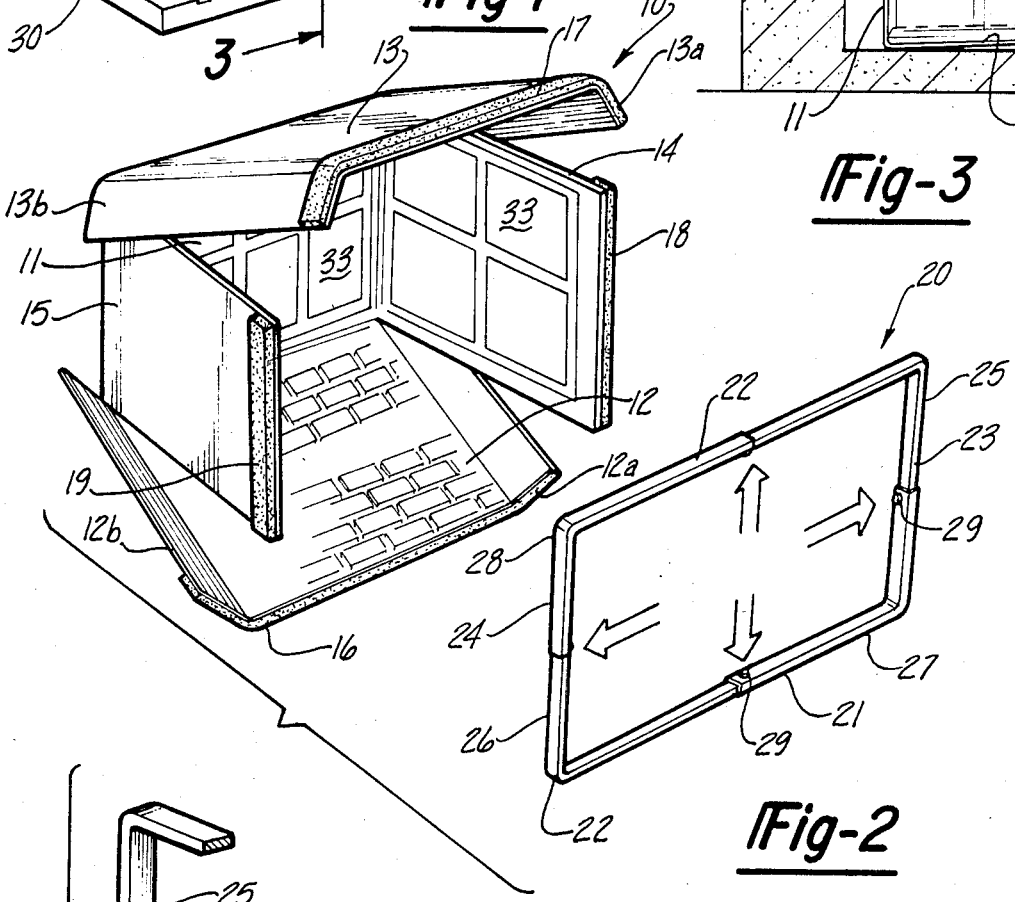
FIG. 2 is an exploded three-dimensional view of the fireplace insert of FIG. 1.
Figure 4:
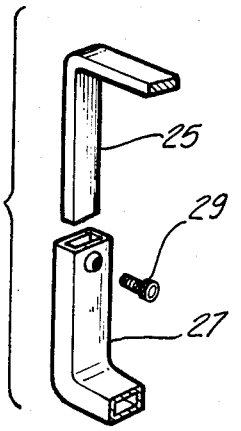
FIG. 4 is an exploded three-dimensional fragmentary view of one of the elements of the fireplace insert of FIGS. 1 through 3.

As is shown in FIGS. 1 and 3, a fireplace insert, indicated generally by reference numeral 10, is shown inserted in a fireplace, indicated generally by reference numeral 30. The fireplace insert 10, as illustrated, includes a back wall 11, a bottom member 12, which is in contact with the back wall 11 along the bottom edge thereof, a top member 13, which is in contact with the back wall 11 along the top edge thereof, and first and second side members 14 and 15, respectively, which are in contact with the back wall 11 along the opposed side edges thereof. The assembled fireplace insert 10 is positioned within the fireplace 30 with the bottom of the back wall 11 resting on, and extending generally vertically upwardly from, a hearth 31 of the fireplace adjacent the rear of a firebox 32 and with the front edges of the bottom member 12, top member 13, and first and second side members 14 and 15 defining a rectangle which is positioned within the opening defined by a face 33 of the fireplace to substantially seal the fireplace. The sealing effect may be advantageously augmented by providing the bottom member 12, top member 13, and first and second side members 14 and 15, respectively, with a thin strip of a sealing material, shown as elements 16, 17, 18 and 19, respectively, on the front outwardly facing edges thereof to continuously sealingly engage the inside surface of the fireplace opening. Sealing elements may be formed, for example, from soft fibrous materials of the type used in the manufacture of weather stripping for doors or from other soft resilient materials, such as elastomeric materials.

The fireplace insert 10 is formed in an integral piece by folding a blank of a suitable thin sheetlike material, and each such blank, which is initially in the form of a cruciform, may be so formed by die-cutting a parent sheet or by directly molding the blank in such form. To accurately position the first and second side members 14 and 15 with respect to the bottom and top members 12 and 13, the bottom and top members may be made somewhat wider than the spacing between the side members, thus, forming extensions 12*a* and 12*b* in the bottom member 12 and extensions 13*a* and 13*b* in the top member 13. These extensions 12*a*, 12*b*, 13*a*, and 13*b* may then be folded to extend vertically along the adjacent edge of the first and second side members 14 and 15.

An insert 20 may advantageously be provided to be inserted within the opening defined by the bottom member 12, top member 13, and side members 14 and 15. The insert 20 is in the form of a thin rectangular frame, including bottom and top legs 21 and 22, respectively, and side legs 23 and 24, and is used to position the front edges of the bottom member 12, top member 13 and first and second side members 14 and 15 within the fireplace opening. For optimum positioning of the bottom member 12, top member 13, and first and second side members 14 and 15 within the opening, the insert 20 is bi-axially extensible, that is, extensible in both the vertical and the horizontal directions. This may be accomplished by constructing the insert 20 from a pair of L-shaped members 25 and 26 and a pair of hollow L-shaped members 27 and 28. The legs of the L-shaped member 25 are telescopically received in the legs of the hollow L-shaped members 27 and 28; similarly, the legs of the L-shaped member 26 are received in the opposed legs of the hollow L-shaped members 27 and 28. The legs of the hollow L-shaped members are provided with tightening screws 29 to firmly restrain the respective legs of the L-shaped members 25 and 26 therein, once the legs have been positioned therein.

For aesthetic purposes the exposed interior surfaces of the fireplace insert may be provided with printed or painted decorations thereon and/or a decorative object, such as a basket of flowers 35, may be placed in the insert after its installation. To provide a tapered configuration to the fireplace insert 10, to permit it to be used in a fireplace with an inwardly tapered firebox, or to permit it to be more easily installed in other types of fireplaces, or to enhance the visual attractiveness of the fireplace insert, the bottom and top members 12 and 13, respectively, of the insert may be formed in the shape of a trapezoid, with the shorter of the parallel sides thereof being disposed toward the rear of the insert, in contact with the back wall 11.

While the present invention has been described in connection with a preferred embodiment and certain modifications thereof, it will be understood that it is not intended to limit the invention to such embodiment and modifications. On the contrary, it is intended to cover all alternatives, modifications and equivalents as may be included within the spirit and scope of the invention as defined by the claims appended hereto.

What is claimed is:

1. A three-dimensional fireplace insert adapted to be inserted in the opening of the firebox of a fireplace and to substantially seal said fireplace to substantially prevent the drawing of air therethrough, said fireplace insert having an opening adapted to be positioned adjacent the opening of said firebox and comprising, in combination:

a generally rectangular back wall which is adapted to be positioned in a generally vertical position within said firebox of said fireplace;

a bottom member which is in contact with said back wall adjacent the bottom of said back wall, said bottom member extending forwardly from said back wall and being adapted to substantially span the bottom of said opening of said firebox;

a top member which is in contact with said back wall adjacent the top of said back wall, said top member extending forwardly from said back wall and being adapted to substantially span the top of said opening of said firebox;

a first side member which is in contact with said back wall adjacent one side thereof and with said top member and said bottom member, said first side member extending forwardly from said back wall and being adapted to substantially span one of the sides of said opening of said firebox;

a second side member which is in contact with said back wall adjacent the other side thereof and with said top member and said bottom member, said second side member extending forwardly from said back wall and being adapted to substantially span the other of the sides of said opening of said firebox;

said back wall, bottom member, first side member and second side member being formed from a unitary blank of an organic sheetlike material by the folding of said unitary blank to permit a multiplicity of such fireplace inserts to be shipped and stored in compact stacks;

said fireplace insert defined by said back wall, bottom member, top member, and first and second side members being substantially impervious to the flow of air therethrough; and an extensible frame disposed within said opening of said three-dimensional fireplace insert to permit said front edges to be accuratedly positioned with respect to said opening of said firebox.

2. The fireplace insert according to claim 1 in which said bottom member and said top member are each trapezoidal in configuration, the shorter of the parallel edges of each of said bottom member and said top member being the portions thereof which are in contact with said back wall of said fireplace insert, whereby said fireplace insert has a tapered configuration for ease of insertion into said firebox.

3. The fireplace insert according to claim 1 further comprising decorative means disposed within said fireplace insert to improve the appearance thereof.

4. A three-dimensional fireplace insert adapted to be inserted in the opening of the firebox of a fireplace and to seal said fireplace to prevent the drawing of air therethrough, said fireplace insert having an opening adapted to be positioned adjacent the opening of said firebox and comprising, in combination;

a generally rectangular back wall which is adapted to be positioned in a generally vertical position within said firebox of said fireplace;

a bottom member which is in contact with said back wall adjacent the bottom thereof, said bottom member extending forwardly from said back wall and having first sealing means on the underside thereof, said first sealing means being adapted to sealingly span the bottom of said opening of said firebox;

a top member which is in contact with the top of said back wall adjacent the top of said back wall, said top member extending forwardly from said back wall and having second sealing means on the top thereof, said second sealing means being adapted to sealingly span said top of said opening of said firebox;

a first side member which is in contact with said back wall adjacent one of the sides thereof and said bottom member and said top member, said first side member extending forwardly from said back wall and having third sealing means on the outside thereof, said third sealing means being adapted to sealingly span one of the sides of said opening of said firebox;

a second side member which is in contact with said back wall adjacent the sides thereof and said bottom member and said top member, said second side member extending forwardly from said back wall and having fourth sealing means on the outside thereof, said fourth sealing means being adapted to sealingly span the other of the sides of said opening of said firebox;

said back wall, bottom member, top member, first side member and second side member being formed from a unitary blank of an organic sheetlike material by the folding of said blank to permit a multiplicity of such blanks to be shipped and stored in compact stacks;

said fireplace insert defined by said back wall, bottom member, top member, and first and second side members being substantially impervious to the flow of air therethrough; and an extensible frame disposed within said opening of said three-dimensional fireplace insert to permit said front edges to be accurately positioned with respect to said opening of said firebox.

5. A fireplace insert according to claim 4 in which said bottom member and said top member are each trapezoidal in configuration, the shorter of the parallel edges of each of said bottom member and said top member being the portions thereof which are in contact with said back wall of said fireplace insert, whereby said fireplace insert has a tapered configuration for ease of insertion into said fireplace.

6. The fireplace insert according to claim 4 further comprising decorative means disposed within said fireplace insert to improve the appearance thereof.

* * * * *

UNITED STATES PATENT AND TRADEMARK OFFICE

CERTIFICATE OF CORRECTION

PATENT NO. : 4,603,682

DATED : August 5, 1986

INVENTOR(S) : Daniel E. Maziasz

It is certified that error appears in the above-identified patent and that said Letters Patent is hereby corrected as shown below:

Column 2, line 45, delete "with".

In the Claims

Column 5, line 28, delete "accuratedly" and insert ---- accurately ----.

Signed and Sealed this

Sixth Day of January, 1987

*Attest:*

*Attesting Officer*

DONALD J. QUIGG

*Commissioner of Patents and Trademarks*